United States Patent [19]

Bailey et al.

[11] Patent Number: 4,971,135

[45] Date of Patent: Nov. 20, 1990

[54] LOST FOAM CASTING APPARATUS

[75] Inventors: Francis V. Bailey, Racine; Russell J. Van Rens, Milwaukee, both of Wis.

[73] Assignee: Outboard Marine Corporation, Waukegan, Ill.

[21] Appl. No.: 325,553

[22] Filed: Mar. 17, 1989

Related U.S. Application Data

[63] Continuation-in-part of Ser. No. 314,482, Feb. 23, 1989, abandoned.

[51] Int. Cl.[5] ..... B22C 5/12

[52] U.S. Cl. ..... 164/192; 222/144.5; 164/237; 164/34; 164/376

[58] Field of Search ..... 164/34, 35, 36, 45, 164/192, 193, 194, 200, 376, 237, 238, 239, 240, 374, 379, 380, 381, 382, 383, 384; 222/144.5, 485

[56] References Cited

U.S. PATENT DOCUMENTS

| | | | |
|---|---|---|---|
| 997,554 | 7/1911 | Holmes | 222/564 |
| 1,119,727 | 12/1914 | Rust | 164/192 |
| 1,127,471 | 2/1915 | MacDonald | 164/192 |
| 1,155,019 | 9/1915 | Tscherning | 164/192 |
| 1,709,604 | 4/1929 | Boynton | 222/564 |
| 2,856,106 | 10/1958 | Madsen | 222/485 |
| 2,859,497 | 11/1958 | Winter | 164/192 |
| 2,931,080 | 4/1960 | Hutchinson et al. | 164/192 |
| 4,593,739 | 6/1986 | VanRens et al. | 164/34 |
| 4,685,504 | 8/1987 | Bond | 164/34 |

FOREIGN PATENT DOCUMENTS

| | | | |
|---|---|---|---|
| 770646 | 10/1980 | U.S.S.R. | 164/193 |
| 1266642 | 10/1986 | U.S.S.R. | 164/192 |

*Primary Examiner*—Richard K. Seidel

*Attorney, Agent, or Firm*—Michael, Best & Friedrich

[57] ABSTRACT

An apparatus comprising a batch hopper including a bottom wall having therein a plurality of openings, a plurality of walls dividing the batch hopper into a plurality of compartments each communicating with a respective one of the openings and each adapted to receive sand from a main hopper, and a sliding gate for simultaneously opening and closing the openings in the bottom wall of the batch hopper.

43 Claims, 3 Drawing Sheets

12
14
16

60
62
40
26
20
34
14
30
36
36
34
26
28
32
32
32
42
44
44
18
14
19

LOST FOAM CASTING APPARATUS

RELATED APPLICATION

This is a continuation-in-part of Ser. No. 314,482, filed Feb. 23, 1989 now abandoned.

BACKGROUND OF THE INVENTION

The invention relates to apparatus used in the lost foam casting process, and more particularly to batch hoppers used in the lost foam casting process.

As shown in FIG. 1, a conventional lost foam casting apparatus 1 includes a mold flask 3 adapted to contain a foam pattern (not shown), and a batch hopper 4 located above the mold flask 3 and adapted to dispense sand 5 into the mold flask 3. The batch hopper 4 includes a bottom wall 6 having therein a plurality of openings 7, and a sliding door or gate 9 that simultaneously opens and closes the openings 7. Such a gate 9 is shown in U.S. Pat. No. 4,593,739, which is assigned to the assignee hereof.

A disadvantage of this construction is that more sand falls through the openings 7 in the center of the hopper 4 than through the openings 7 near the periphery of the hopper 4 due to friction along the walls of the hopper 4 and due to the tendency of aggregate material to assume an angle of repose on its surface, both of which cause sand to slide toward the center of the hopper 4. Uneven flow rates of sand into the mold flask 3 can damage the foam pattern in the mold flask.

Attention is directed to the following U.S. patents:

| | | |
|---|---|---|
| Holmes | 997,554 | July 11, 1911 |
| Rust | 1,119,727 | Dec. 1, 1914 |
| MacDonald | 1,127,471 | Feb. 9, 1915 |
| Tscherning | 1,155,019 | Sept. 28, 1915 |
| Boynton | 1,709,604 | Apr. 16, 1929 |
| Hutchinson | 2,931,080 | Apr. 5, 1960 |
| Winter | 2,859,497 | Nov. 11, 1958 |
| VanRens | 4,593,739 | June 10, 1986 |

Attention is also directed to U.S.S.R. Pat. No. 770-646, and 1,266,642.

SUMMARY OF THE INVENTION

The invention provides a lost foam casting apparatus comprising a batch hopper having therein a plurality of openings, means for dividing the batch hopper into a plurality of discrete volumes each communicating with a respective one of the openings and each adapted to contain sand, means for simultaneously opening and closing the openings, and a mold flask located beneath the batch hopper, adapted to contain a foam pattern and adapted to receive sand flowing through the openings.

In one embodiment, the batch hopper includes side walls and a bottom wall defining an interior space communicating with the openings, the openings are located in the bottom wall, and the dividing means includes a plurality of walls extending between the side walls.

The invention also provides apparatus comprising a hopper having therein a plurality of openings, means for dividing the hopper into a plurality of discrete volumes each communicating with a respective one of the openings, and means for simultaneously opening and closing the openings.

The invention also provides a lost foam casting apparatus comprising a batch hopper including side walls, a bottom wall having therein a plurality of openings, and a plurality of walls extending between said side walls for dividing said batch hopper into a plurality of discrete volumes each communicating with a respective one of said openings.

The invention also provides a lost foam casting apparatus comprising a batch hopper, means for dividing the batch hopper into a plurality of discrete compartments, and means for dispensing substantially equal volumes of sand into the compartments.

The invention also provides a lost from casting apparatus comprising a batch hopper, means for dispensing a volume of sand into the batch hopper, and means in the batch hopper for dividing the volume of sand into portions having substantially equal volumes.

A principal feature of the invention is the provision of means of dividing a batch hopper into a plurality of compartments each communicating with a respective one of the openings in the bottom wall of the batch hopper, and means for simultaneously opening and closing the openings in the bottom wall of the batch hopper. With this arrangement, the relative flow rates of sand through the openings can be controlled by controlling the relative volumes of sand in the compartments.

Other features and advantages of the invention will become apparent to those skilled in the art upon review of the following detailed description, claims and drawings.

Figure 2:
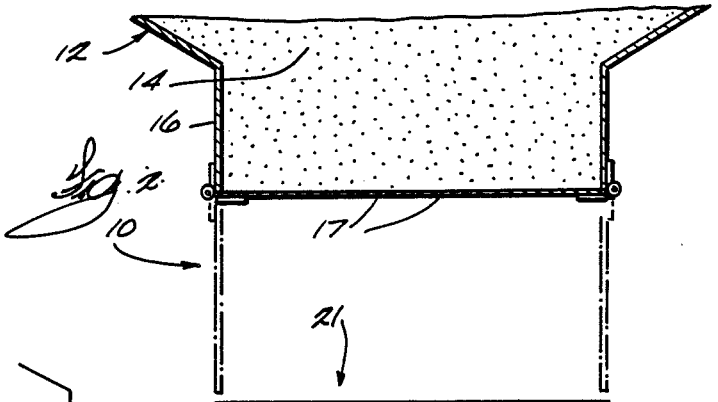
FIG. 2 is a side elevational view, partially in section, of an apparatus embodying the invention and comprising a batch hopper.

Before one embodiment of the invention is explained in detail, it is to be understood that the invention is not limited in its application to the details of construction and the arrangements of components set forth in the following description or illustrated in the drawings. The invention is capable of other embodiments and of being practiced or being carried out in various ways. Also, it is to be understood that the phraseology and terminology used herein is for the purpose of description and should not be regarded as limiting.

DESCRIPTION OF THE PREFERRED EMBODIMENT

Figure 4:
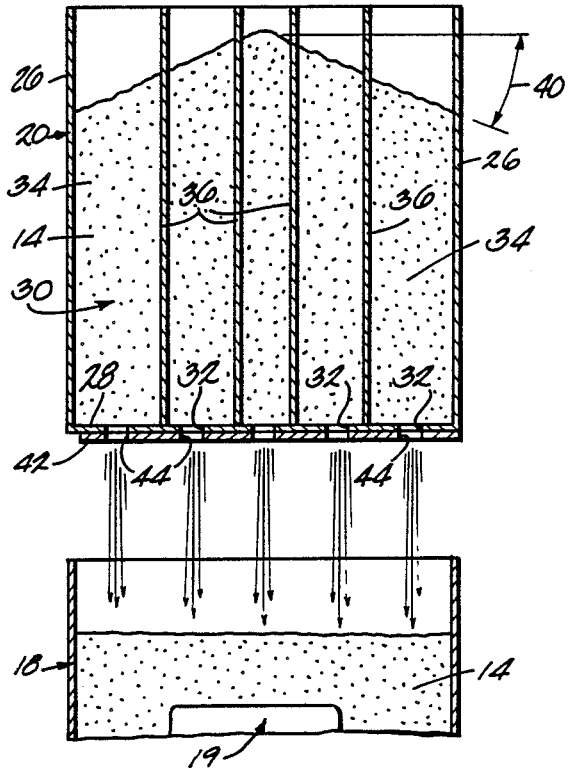
FIG. 4 is a bottom plan view of the batch hopper.
Figure 4:
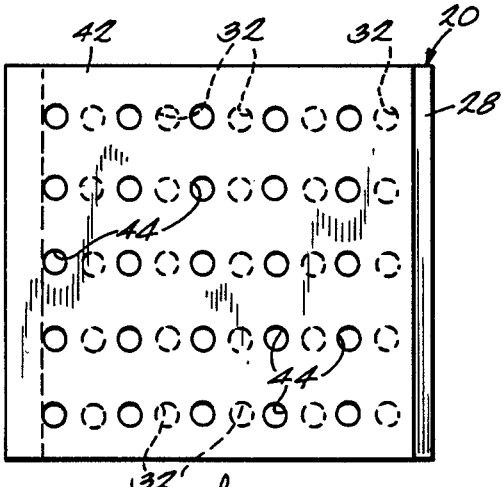
Figure 3:
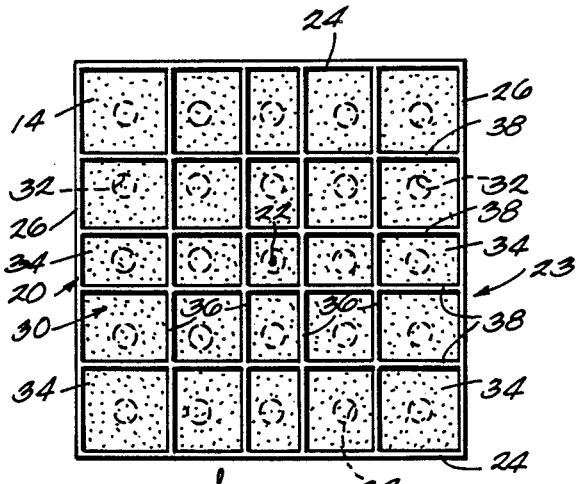
FIG. 3 is a top plan view of the batch hopper.

A lost foam casting apparatus 10 embodying the invention is illustrated in FIGS. 2–4. As shown in FIG. 2, the apparatus 10 comprises a main hopper 12 adapted to contain sand 14. The main hopper 12 includes a discharge chute 16 and suitable means, such as doors 17, for opening and closing the discharge chute 16.

The apparatus 10 also comprises a mold flask 18 adapted to contain a foam pattern 19, and means for filling the mold flask with free-falling sand and for maintaining a substantially level upper surface of the sand in the mold flask 18. In the illustrated embodiment, this means includes a batch hopper 20 located beneath the discharge chute 16 of the main hopper 12 and located above the mold flask 18. The batch hopper 20 is adapted to receive sand from the main hopper 12 and the mold flask 18 is adapted to receive sand from the batch hopper 20. The batch hopper 20 has an open upper end 21, a center 22 (FIG. 3) and a periphery 23 and includes side walls 24 and 26 and a bottom wall 28 defining an interior space 30. The bottom wall 28 has therein a plurality of openings 32 communicating with the interior space 30. In the illustrated construction, the bottom wall 28 has therein five rows of five openings 32. In the preferred embodiment, the openings 32 have equal sizes or areas, and the openings 32 are evenly distributed over the bottom wall 28.

The means for filling the mold flask 18 also includes means dividing the interior space 30 of the batch hopper 20 into a plurality of discrete volumes or compartments 34 each communicating with a respective one of the openings 32 and each adapted to receive sand from the main hopper 12. While various suitable dividing means can be employed, in the illustrated embodiment, such means includes a plurality of walls 36 and 38 extending between the side walls 24 and 26 of the batch hopper 20. More particularly, as shown in FIG. 3, the batch hopper 20 has therein four generally parallel, spaced partition walls 36 extending between the side walls 24, and four generally parallel, spaced partition walls 38 extending between the side walls 26 and intersecting the walls 36. The walls 36 and 38 divide the interior space 30 of the batch hopper 20 into twenty-five compartments 34.

Sand discharged from the main hopper 12 has an angle of repose 40 as shown in FIG. 2. In order to obtain equal volumes of sand in the various compartments 34, the compartments 34 located near the center 22 of the batch hopper 20 have a smaller cross-sectional area than the compartments 34 located near the periphery 23 of the batch hopper 20. To this end, the walls 36 and 38 are more closely spaced near the center 22 of the hopper 20 than near the side walls 24 and 26. This is shown in FIG. 3. Because the height of the sand in the central compartments 34 will be greater than the height of the sand in the peripheral compartments 34, as shown in FIG. 2, the volumes of sand in the compartments 34 will be substantially equal.

The means for filling the mold flask 18 also includes means for simultaneously opening and closing the openings 32. While various suitable opening and closing means can be employed, in the illustrated embodiment, such means includes a sliding door or gate 42 movable between an open position (FIG. 2) and a closed position (FIG. 4). The gate 42 has therein a plurality of openings 44 each of which is aligned with a respective opening 32 when the gate 42 is in its open position and each of which is misaligned with its respective opening 32 when the gate 42 is in its closed position.

The apparatus 10 operates as follows. First, with the gate 42 in its closed position, sand is discharged from the main hopper 12 so that the compartments 34 are filled with substantially equal volumes of sand. Next, the gate 42 is moved to its open position so that sand flows through the openings 32 and 44 and into the mold flask 50. Because the openings 32 are evenly distributed over the bottom wall 28 of the batch hopper 20, the openings 32 fill substantially equal areas of the mold flask 18. Because the compartments 34 contain substantially equal volumes of sand, the volumes of sand flowing through the openings 32 and 44 are substantially equal. Therefore, the upper surface of the sand in the mold flask 18 is maintained substantially level during filling of the mold flask 18.

Figure 1:
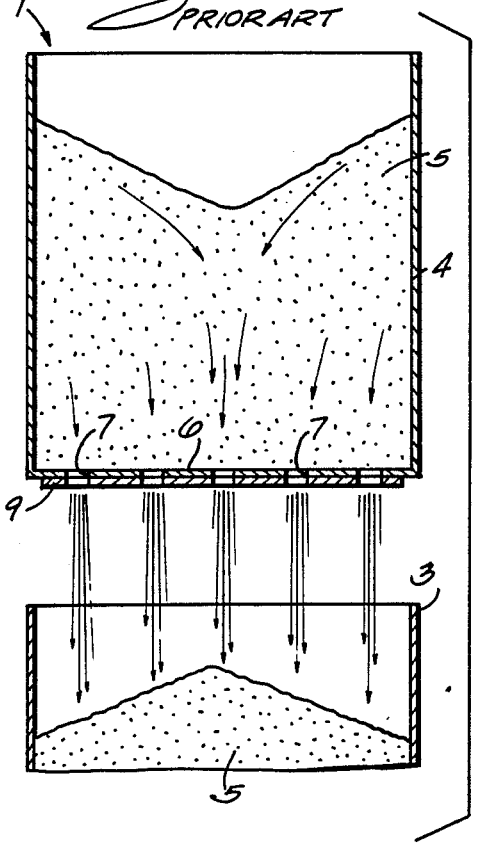
Fig. 1 PRIOR ART
FIG. 1 is a side elevational view, partially in section, of a prior art apparatus.

Alternatives (not shown) to dividing the batch hopper 20 into compartments are making the openings 32 and 44 near the periphery 23 of the batch hopper 20 larger than the openings 32 and 44 near the center 22 of the batch hopper 20, and making the openings 32 and 44 more closely spaced near the periphery 23 of the batch hopper 20 than near the center 22 of the batch hopper 20. Both of these alternatives would cause more sand to flow through the peripheral openings 32 and 44 than is the case with the prior art construction shown in FIG. 1.

If the volume of the mold pattern 19 is not evenly distributed over the area of the mold flask 18, it may be desirable to vary the volumes of the compartments 34 so that the volumes are not substantially equal. For example, if most of the volume of the mold pattern 19 is located in the center of the mold flask 18, it may be desirable to have less sand deposited in the center of the mold flask 18 than near the periphery of the mold flask 18. This could be accomplished by making the volumes of the central compartments 34 less than the volumes of the peripheral compartments 34.

Figure 5:
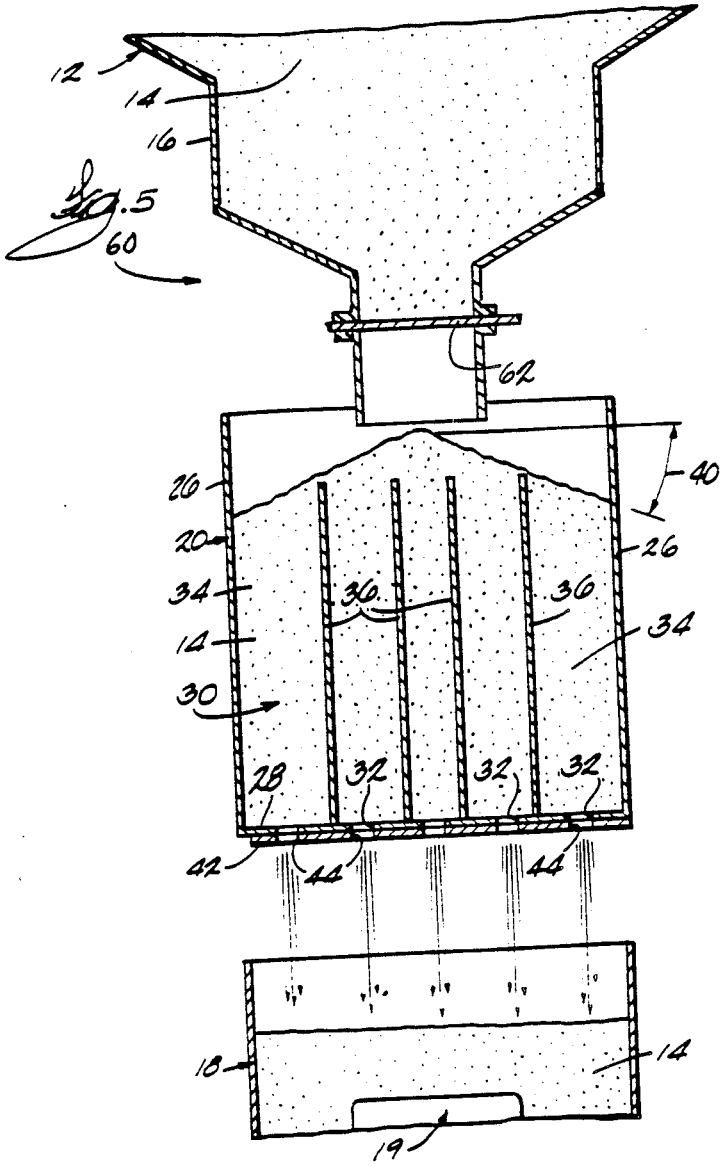
FIG. 5 is a view similar to FIG. 2 and illustrating a second embodiment of the invention.
Figure 6:
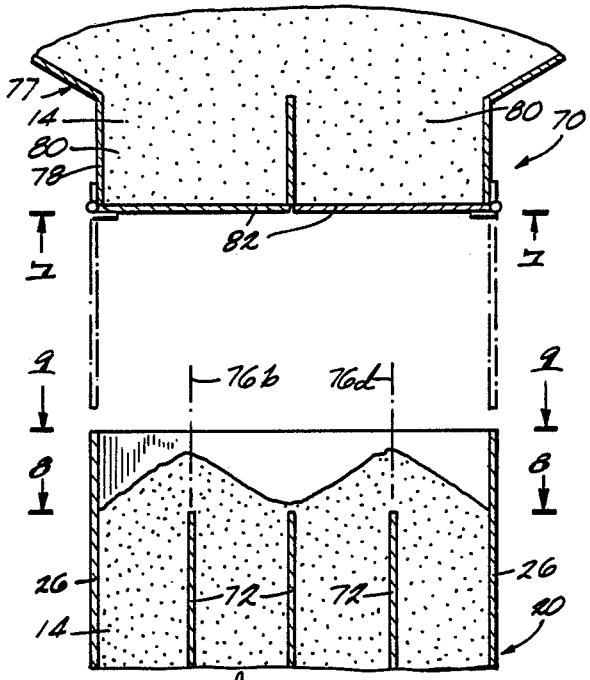
FIG. 6 is a view which is similar to FIG. 2, which is taken along line 6—6 in FIG. 8 and which illustrates a third embodiment of the invention.
Figure 8:
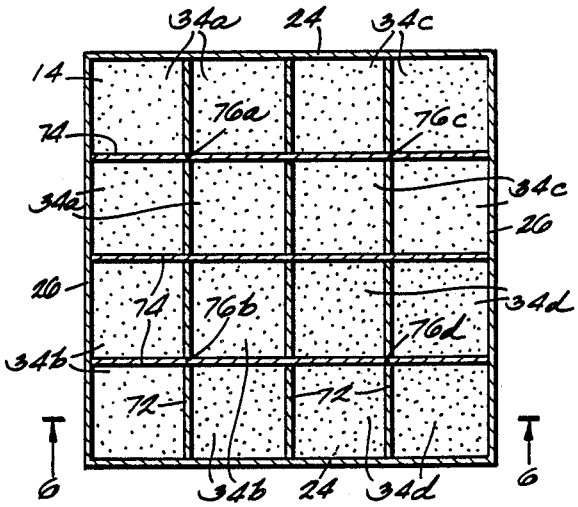
FIG. 8 is a view taken along line 8—8 in FIG. 6.
Figure 7:
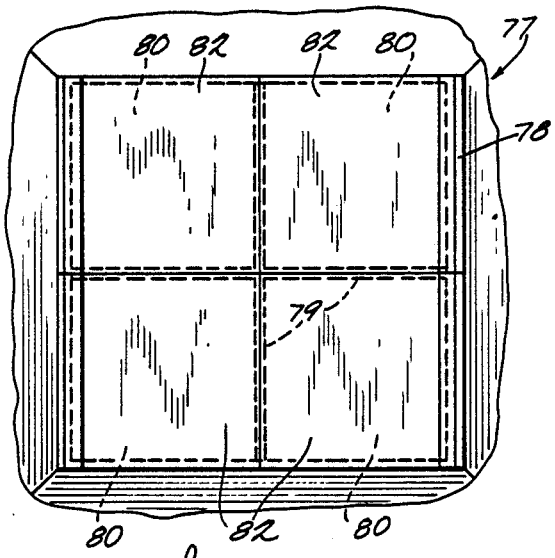
FIG. 7 is a view taken along line 7—7 in FIG. 6.
Figure 9:
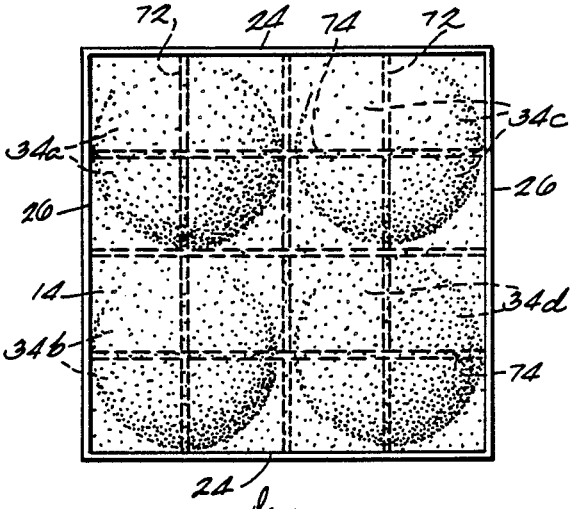
FIG. 9 is a view taken along line 9—9 in FIG. 6.

An apparatus 60 which is an alternative embodiment of the invention is illustrated in FIG. 5. The apparatus 60 is similar to the apparatus 10 illustrated in FIG. 2, and common elements have been given the same reference numerals.

In the alternative embodiment, the area of the discharge chute 16 is equal to approximately 25% of the area of the batch hopper 20, the doors 17 of the embodiment illustrated in FIG. 2 are replaced by a sliding gate 62, and the discharge chute 16 is positioned over the center 22 of the batch hopper 20. Also, the walls 24 and 26 of the batch hopper 20 extend above the upper ends of the partitions or walls 36 and 38, as shown in FIG. 5. Furthermore, the batch hopper 20 is movable vertically relative to the main hopper 12. When sand is discharged from the discharge chute 16 into the batch hopper 20, the sand first fills the central compartments 34, above which the discharge chute 16 is positioned, and then spills over into the peripheral compartments 34. When the upper surface of the sand reaches the lower end of the discharge chute 16, sand flow is discontinued, the gate 62 is closed and the batch hopper 20 is lowered relative to the main hopper 12. As shown in FIG. 5, the end result (i.e., the distribution of sand in the batch hopper 20) is substantially the same as in the embodiment illustrated in FIG. 2.

An apparatus 70 which is a second alternative embodiment of the invention is illustrated in FIGS. 6 through 9. The apparatus 70 is similar to the apparatus 10 illustrated in FIG. 2, and common elements have been given the same reference numerals.

In the apparatus 70, the means for dividing the batch hopper 20 includes (see FIGS. 6, 8 and 9), instead of the walls 36 and 38 of the apparatus 10, a first set of three generally parallel, equally spaced walls 72 extending in generally vertical planes, and a second set of three generally parallel, equally spaced walls 74 extending generally perpendicular to the first set of walls 72, extending in generally vertical planes and intersecting the first set of walls 72 to define sixteen compartments **34*a*, 34*b*, 34*c* and 34*d* having substantially equal volumes. The compartments include four compartments 34*a* centered on a generally vertical line 76*a*, four compartments 34*b* centered on a generally vertical line 76b, four compartments 34c centered on a generally vertical line 76c and four compartments 34d centered on a generally vertical line 76d**.

The apparatus 70 also comprises means for dispensing substantially equal volumes of sand into the compartments 34a–d. Preferably, this means includes (see FIGS. 6 and 7) a main hopper 77 which is located above the batch hopper 20 and which includes a discharge chute 78 that is divided by perpendicular partitions 79 into four discharge chute portions 80. Each of the discharge chute portions 80 is centered above four of the compartments 34a–d, i.e., is centered on one of the vertical lines 76a–d. Instead of the doors 17 of the apparatus 10, the apparatus 70 includes four doors 82, each of which controls sand flow through a respective chute portion 80.

When sand is dispensed from the main hopper 77, the four chute portions 80 create four "hills" of sand in the batch hopper 20 (see FIGS. 6 and 9), with each "hill" having an angle of repose. Because each chute portion 80 is centered over four compartments, each "hill" is divided by the partitions or walls 72 and 74 into four portions (one in each compartment) having substantially equal volumes. Thus, the compartments 34a–d have therein substantially equal volumes of sand.

Each of the discharge chute portions 80 constitutes means for dispensing a volume of sand into the batch hopper 20, and the walls 72 and 74 constitute means in the batch hopper 20 for dividing the volume of sand into portions having substantially equal volumes.

Various features of the invention are set forth in the following claims.

We claim:

1. A lost foam casting apparatus comprising a batch hopper having a volume and having therein a plurality of openings, means for dividing a majority of the volume of said batch hopper into a plurality of discrete volumes each communicating with a respective one of said openings and each adapted to contain sand, means for opening and closing said openings, and a mold flask located beneath said batch hopper, adapted to contain a foam pattern and adapted to receive sand flowing through said openings.

2. An apparatus as set forth in claim 1 wherein said batch hopper includes side walls and a bottom wall defining an interior space communicating with said openings, wherein said openings are located in said bottom wall, and wherein said dividing means includes a plurality of partition walls extending between said side walls.

3. An apparatus as set forth in claim 1 wherein said partition walls have upper ends, and wherein said side walls extend above said upper ends.

4. An apparatus as set forth in claim 1 wherein said hopper includes a bottom wall having therein said openings, and wherein said opening and closing means includes a sliding door which is movable between an open position and a closed position and which has therein a plurality of openings each of which is aligned with a respective one of said openings in said bottom wall when said sliding door is in said open position and each of which is misaligned with said respective opening in said bottom wall when said sliding door is in said closed position.

5. An apparatus as set forth in claim 1 wherein said hopper includes a bottom wall having a center and a periphery and having therein a central opening located adjacent said center and a peripheral opening located adjacent said periphery, wherein said dividing means divides said batch hopper into a central compartment having a cross-sectional area and communicating with said central opening, and a peripheral compartment having a cross-sectional area and communicating with said peripheral opening, and wherein said cross-sectional area of said central compartment is less than said cross-sectional area of said peripheral compartment.

6. Apparatus as set forth in claim 5 wherein said bottom wall has therein a plurality of peripheral openings located adjacent said periphery, and wherein said dividing means divides said hopper into a plurality of peripheral compartments surrounding said central compartment, each of said peripheral compartments communicating with a respective one of said peripheral openings and having a cross-sectional area greater than said cross-sectional area of said central compartment.

7. An apparatus as set forth in claim 1 wherein said dividing means divides substantially all of the volume of said batch hopper into said discrete volumes.

8. An apparatus as set forth in claim 1 wherein said opening and closing means alternatively simultaneously opens said openings and simultaneously closes said openings.

9. Apparatus as set forth in claim 1 wherein said hopper has therein a certain number of openings, wherein said dividing means divides said hopper into said certain number of discrete volumes, and wherein said volumes communicate respectively with said openings.

10. Apparatus comprising a hopper having a volume and having therein a plurality of openings, means for dividing a majority of the volume of said hopper into a like plurality of discrete volumes communicating respectively with said openings, and means for opening and closing said openings.

11. Apparatus as set forth in claim 10 wherein said hopper includes side walls and a bottom wall defining an interior space communicating with said openings, wherein said openings are located in said bottom wall, and wherein said dividing means includes a plurality of partition walls extending between said side walls.

12. Apparatus as set forth in claim 11 wherein said partition walls have upper ends, and wherein said side walls extend above said upper ends.

13. Apparatus as set forth in claim 10 wherein said hopper includes a bottom wall having therein said openings, and wherein said opening and closing means includes a sliding door which is movable between an open position and a closed position and which has therein a plurality of openings each of which is aligned with a respective one of said openings in said bottom wall when said sliding door is in said open position and each of which is misaligned with said respective opening in said bottom wall when said sliding door is in said closed position.

14. Apparatus as set forth in claim 10 wherein said hopper includes a bottom wall having a center and a periphery and having therein a central opening located adjacent said center and a peripheral opening located adjacent said periphery, wherein said dividing means divides said hopper into a central compartment having a cross-sectional area and communicating with said central opening, and a peripheral compartment having a cross-sectional area and communicating with said peripheral opening, and wherein said cross-sectional area of said central compartment is less than said cross-sectional area of said peripheral compartment.

15. Apparatus as set forth in claim 14 wherein said bottom wall has therein a plurality of peripheral openings located adjacent said periphery, and wherein said dividing means divides said hopper into a plurality of peripheral compartments surrounding said central compartment, each of said peripheral compartments communicating with a respective one of said peripheral openings and having a cross-section area greater than said cross-sectional are of said central compartment.

16. Apparatus as set forth in claim 10 wherein said dividing means divides substantially all of the volume of said hopper into said discrete volumes.

17. Apparatus as set forth in claim 10 wherein said opening and closing means alternatively simultaneously opens said openings and simultaneously closes said openings.

18. A lost foam casting apparatus comprising a batch hopper including side walls having a height, a bottom wall having therein a plurality of openings, and a plurality of partition walls extending between said side walls, having a height equal to at least one-half of the height of said side walls, and dividing said batch hopper into a plurality of discrete volumes each communicating with a respective one of said openings.

19. An apparatus as set forth in claim 11 wherein said partition walls have upper ends, and wherein said side walls extend above said upper ends.

20. An apparatus as set forth in claim 18 and further comprising means for alternatively simultaneously opening said openings and simultaneously closing said openings.

21. An apparatus as set forth in claim 20 wherein said opening and closing means includes a sliding door which is movable between an open position and a closed position and which has therein a plurality of openings each of which is aligned with a respective one of said openings in said bottom wall when said sliding door is in said open position and each of which is misaligned with said respective openings in said bottom wall when said sliding door is in said closed position.

22. An apparatus as set forth in claim 18 wherein said bottom wall has a center and a periphery and has therein a central opening located adjacent said center and a peripheral opening located adjacent said periphery, wherein said partition walls divide said batch hopper into a central compartment having a cross-sectional area and communicating with said central opening, and a peripheral compartment having a cross-sectional area and communicating with said peripheral opening, and wherein said cross-sectional area of said central compartment is less than said cross-sectional area of said peripheral compartment.

23. Apparatus as set forth in claim 22 wherein said bottom wall has therein a plurality of peripheral openings located adjacent said periphery, and wherein said partition walls divide said hopper into a plurality of peripheral compartments surrounding said central compartment, each of said peripheral compartments communicating with a respective one of said peripheral openings and having a cross-sectional area greater than said cross-sectional area of said central compartment.

24. An apparatus as set forth in claim 18 wherein said partition walls have a height substantially equal to the height of said side walls.

25. Apparatus as set forth in claim 18 wherein said hopper has therein a certain number of openings, wherein said partition walls divide said hopper into said certain number of discrete volumes, and wherein said volumes communicate respectively with said openings.

26. A lost foam casting apparatus comprising a batch hopper, means for dividing said batch hopper into a plurality of discrete compartments, and means for dispensing substantially equal volumes of sand into said compartments.

27. An apparatus as set forth in claim 26 wherein said dividing means includes a pair of generally perpendicular walls extending in generally vertical planes and intersecting to define a generally vertical line, wherein said dispensing means includes a main hopper located above said batch hopper and including a discharge chute portion centered on said line.

28. An apparatus as set forth in claim 27 wherein said dividing means includes a first set of three generally parallel, spaced walls extending in generally vertical planes, and a second set of three generally parallel, spaced walls extending generally perpendicular to said first set of walls, extending in generally vertical planes and intersecting said first set of walls to define sixteen compartments, and wherein said main hopper includes four discharge chute portions, each of said chute portions being centered above four of said compartments.

29. A lost foam casting apparatus comprising a batch hopper, means for dispensing a volume of sand into said batch hopper, and means in said batch hopper for dividing said volume of sand into portions having substantially equal volumes.

30. An apparatus as set forth in claim 29 wherein said dividing means includes a pair of generally perpendicular walls extending in generally vertical planes and intersecting to define a generally vertical line, and wherein said dispensing means includes a main hopper located above said batch hopper and including a discharge chute portion centered on said line.

31. An apparatus as set forth in claim 30 wherein said dividing means includes a first set of three generally parallel, spaced walls extending in generally vertical planes, and a second set of three generally parallel, spaced walls extending generally perpendicular to said first set of walls, extending in generally vertical planes and intersecting said first set of walls to define sixteen compartments, and wherein said main hopper includes four discharge chute portions, each of said chute portions being centered above four of said compartments.

32. A lost foam casting apparatus comprising a batch hopper including a bottom wall having a center and a periphery and having therein a central opening located adjacent said center and a peripheral opening located adjacent said periphery, means for dividing said batch hopper into a plurality of discrete volumes each communicating with a respective one of said openings and each adapted to contain sand, said dividing means dividing said batch hopper into a central compartment having a cross-sectional area and communicating with said central opening, and a peripheral compartment having a cross-sectional area and communicating with said peripheral opening, said cross-sectional area of said central compartment being less than said cross-section area of said peripheral compartment, means for opening and closing said openings, and a mold flask located beneath said batch hopper, adapted to contain a foam pattern and adapted to receive sand flowing through said openings.

33. Apparatus as set forth in claim 32 wherein said bottom wall has therein a plurality of peripheral openings located adjacent said periphery, and wherein said dividing means divides said hopper into a plurality of peripheral compartments surrounding said central compartment, each of said peripheral compartments communicating with a respective one of said peripheral openings and having a cross-sectional area greater than said cross-sectional area of said central compartment.

34. Apparatus as set forth in claim 32 wherein said hopper has therein a certain number of openings, wherein said dividing means divides said hopper into said certain number of discrete volumes, and wherein said volumes communicate respectively with said openings.

35. Apparatus comprising a hopper including a bottom wall having a center and a periphery and having therein a central opening located substantially at said center and a peripheral opening located adjacent said periphery, means for dividing said hopper into a plurality of discrete volumes each communicating with a respective one of said openings, said dividing means dividing said hopper into a central compartment having a cross-sectional area and communicating with said central opening, and a peripheral compartment having a cross-sectional area and communicating with said peripheral opening, said cross-sectional area of said central compartment being less than said cross-sectional area of said peripheral compartment, and means for opening and closing said openings.

36. Apparatus as set froth in claim 35 wherein said bottom wall has therein a plurality of peripheral openings located adjacent said periphery, and wherein said dividing means divides said hopper into a plurality of peripheral compartments surrounding said central compartment, each of said peripheral compartments communicating with a respective one of said peripheral openings and having a cross-sectional area greater than said cross-sectional area of said central compartment.

37. A lost foam casting apparatus comprising a batch hopper including side walls, a bottom wall having a center and a periphery and having therein a plurality of openings including a central opening located adjacent said center and a peripheral opening located adjacent said periphery, and a plurality of partition walls extending between said side walls and dividing said batch hopper into a plurality of discrete volumes each communicating with a respective one of said openings, said partition walls dividing said batch hopper into a central compartment having a cross-sectional area and communicating with said central opening, and a peripheral compartment having a cross-sectional area and communicating with said peripheral opening, said cross-sectional area of said central compartment being less than said cross-sectional area of said peripheral compartment.

38. Apparatus as set forth in claim 37 wherein said bottom wall has therein a plurality of peripheral openings located adjacent said periphery, and wherein said partition walls divide said hopper into a plurality of peripheral compartments surrounding said central compartment, each of said peripheral compartments communicating with a respective one of said peripheral openings and having a cross-sectional area greater than said cross-sectional area of said central compartment.

39. Apparatus as set forth in claim 37 wherein said hopper has therein a certain number of openings, wherein said partition walls divide said hopper into said certain number of discrete volumes, and wherein said volumes communicate respectively with said openings.

40. A lost foam casting apparatus comprising a batch hopper, means for dividing said batch hopper into a plurality of discrete compartments, said dividing means including a first set of three generally parallel, spaced walls extending in generally vertical planes, and a second set of three generally parallel, spaced walls extending generally perpendicular to said first set of walls, extending in generally vertical planes and intersecting said first set of walls to define sixteen compartments, and means for dispensing substantially equal volumes of sand into said compartments, said dispensing means including a main hopper located above said batch hopper and including four discharge chute portions, each of said chute portions being centered above four of said compartments.

41. A lost foam casting apparatus comprising a batch hopper, means for dispensing a volume of sand into said batch hopper, said dispensing means including a main hopper located above said batch hopper and including four discharge chute portions, and means in said batch hopper for dividing said volume of sand into portions having substantially equal volumes, said dividing means including a first set of three generally parallel, spaced walls extending in generally vertical planes, and a second set of three generally parallel. spaced walls extending generally perpendicular to said first set of walls, extending in generally vertical planes and intersecting said first set of walls to define sixteen compartments, each of said chute portions being centered above four of said compartments.

42. Apparatus comprising a hopper including a bottom wall having a center and a periphery and having therein a plurality of openings including a central opening located adjacent said center and a peripheral opening located adjacent said periphery, means for dividing said hopper into a like plurality of discrete volumes communicating respectively with said openings, said dividing means dividing said hopper into a central compartment having a cross-sectional area and communicating with said central opening, and a peripheral compartment having a cross-sectional area and communicating with said peripheral opening, said cross-sectional area of said central compartment being less than said cross-sectional area of said peripheral compartment, and means for opening and closing said openings.

43. Apparatus comprising a hopper including a bottom wall having a center and a periphery and having therein a plurality of openings including a central opening located substantially at said center and a peripheral opening located adjacent said periphery, means for dividing said hopper into a like plurality of discrete volumes communicating respectively with said openings, said dividing means dividing said hopper into a central compartment having a cross-sectional area and communicating with said central opening, and a peripheral compartment having a cross-sectional area and communicating with said peripheral opening, said cross-sectional area of said central compartment being less than said cross-sectional area of said peripheral compartment, and means for opening and closing said openings.

* * * * *